United States Patent [19]

Nakayama et al.

[11] 3,951,581

[45] Apr. 20, 1976

[54] COMBUSTION METHOD OF PAINT WASTE DISPOSAL

[75] Inventors: Minoru Nakayama; Yusai Yamahata, both of Ichihara, Japan

[73] Assignee: Mitsui Shipbuilding & Engineering Co., Ltd., Tokyo, Japan

[22] Filed: June 15, 1973

[21] Appl. No.: 370,434

[30] Foreign Application Priority Data

June 22, 1972 Japan ..... 47-63021

[52] U.S. Cl. ..... 431/4; 110/7 R; 110/7 S

[51] Int. Cl.[2] ..... F23J 7/00

[58] Field of Search ..... 110/7 R, 7 S; 431/4

[56] References Cited

UNITED STATES PATENTS

| | | | |
|---|---|---|---|
| 2,033,010 | 3/1936 | Russell | 431/4 |
| 3,357,375 | 12/1967 | Brophy | 110/7 S |
| 3,383,049 | 5/1968 | Guerin | 239/400 |
| 3,741,712 | 6/1973 | Delatronchette | 431/4 X |
| 3,748,081 | 7/1973 | Hummell | 110/7 R |
| 3,750,600 | 8/1973 | Ohsol et al. | 110/7 S |
| 3,757,706 | 9/1973 | Pariel et al. | 110/7 S |
| 3,766,942 | 10/1973 | Delatronchette et al. | 431/4 X |
| 3,776,147 | 12/1973 | Ensslin | 110/7 S |
| 3,828,700 | 8/1974 | Ragot | 110/7 S |

*Primary Examiner*—Charles J. Myhre
*Assistant Examiner*—William P. Anderson
*Attorney, Agent, or Firm*—Howson and Howson

[57] ABSTRACT

A method of disposing of solid or paste-like paint waste in which the paint waste is firmly comminuted and mixed with waste oil and water, preferably with detergent present, to form a low-sedimentation rate slurry, and the slurry then incinerated to provide substantially complete combustion of said paint waste.

7 Claims, 2 Drawing Figures

COMBUSTION METHOD OF PAINT WASTE DISPOSAL

The present invention relates to a method of incineration disposal of paint waste.

Paint waste generated in painting work has been disposed of by dumping on vacant ground, by reclamation, by open incineration, etc. However, such conventional disposal causes secondary pollution such as the diffusion of solvents and heavy metals into the ground, and the generation of black smoke. Therefore, it is most preferable to dispose paint waste by complete combustion. However, paint waste is in the form of semisolid or paste and has high adhesiveness. For this reason, it is very difficult to handle paint waste, and it is impossible to burn it continuously and completely by conventional means.

The present invention provides a process in which the paint waste is finely comminuted and dispersed in oil to form a non-adhesive slurry whereby it may be atomized and burned.

According to the present invention, waste oil is preferably used as mother liquor for preventing the sedimentation of paint waste particles. Therefore, the present invention has as an advantage the simultaneous disposal of paint waste and waste oil. Further, detergent commonly present in waste oil assists in maintaining the slurry in a stable state. Compared with disposal methods of paint waste using thinner as solvent, the cost of disposal of the disposal method according to the present invention is very low. Furthermore, the disposal process using solvents is very dangerous due to rapid volatilization of thinner, but in accordance with the present invention the paint waste may be safely disposed of. The slurry of paint waste produced in the process of the present invention can be handled as liquid. Accordingly the slurry can be continuously fed to a burner at a constant rate, and paint waste can be disposed by complete combustion without pollution.

Figure 1:
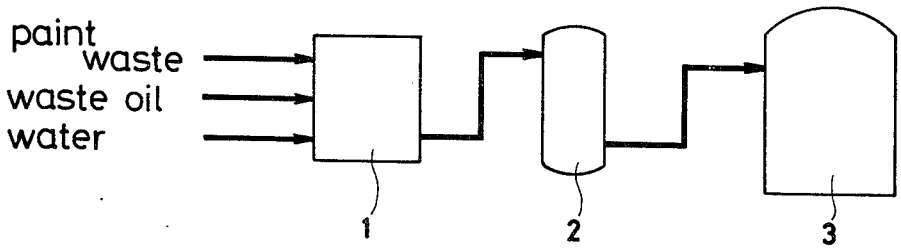
Figure 2:
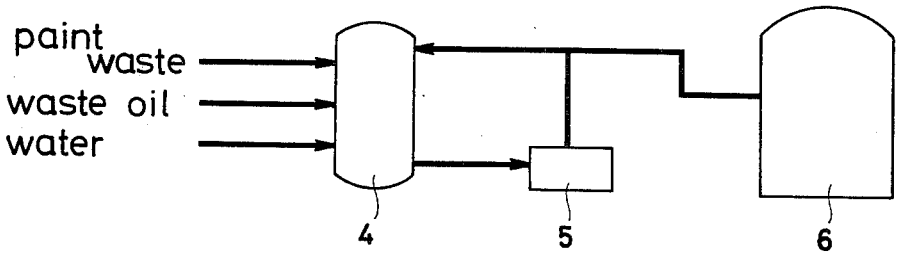

The present invention will be explained with reference to the accompanying drawings, in which, FIG. 1 shows the block diagram of a batch system of paint waste disposal according to the present invention; and FIG. 2 shows in block form another system of waste paint disposal according to the present invention.

FIG. 1 shows batch system in which paint waste, waste oil and water are thrown in the shear type mixing tank 1 in the proper ratio, and a cutting, dispersing and mixing operation in the tank is performed for a predetermined period. The resulting slurry is fed to a storage tank 2, and wherefrom fed continuously to an incinerator 3 to be burned.

FIG. 2 shows a continuous system in which paint waste, waste oil and water are continuously fed to the mixing tank 4 in the proper ratio and the paint waste is broken into particles of preferable size. The resulting solution is fed to a wet type disposer or disintegrator 5, the paint waste is further ground into fine particles, dispersed and mixed, and thereafter returned to the storage tank 4. After passing through the wet type disposer or disintegrator 5, a part of the solution is continuously fed to an incinerator 6 to be burned.

The following table shows various kinds of mixing ratio of paint waste, waste oil and water. In this example, the mixture of paint waste, waste oil and water are treated for 5 minutes by a small shear type mixer.

It is preferable to use waste oil containing 40 to 60 percent of water as mother liquor or carrier. It is desirable to use waste oil containing detergent like waste lubricating oil. Detergent shows the same action in lubricating oil as well as in waste oil. More particularly, detergent acts on the surface of paint waste particles dispersed in waste oil to lower cohesive force among particles, prevent their coagulation and disperse them more homogeneously. Water has a great effect in that it produces a stable emulsion with waste oil and prevents the sedementation of paint waste particles dispersed in waste oil.

Table

Example of mixing ratio of paint waste, waste oil and water

| | Mother liquor | Mixing ratio (wt%) | | | Detergent | Remarks | Result |
|---|---|---|---|---|---|---|---|
| | | Paint waste | Mother liquor | Water | | | |
| 1 | B heavy oil | 50 | 50 | — | Added | Paint waste dispersed in larger particle and rapidly settled | Good |
| 2 | " | 50 | 50 | — | Not added | Sedimentation: rapid Redispersion: difficult | Fair |
| 3 | " | 50 | 40 | 10 | Not added | Sedimentation: rapid Redispersion: difficult | Fair |
| 4 | " | 50 | 40 | 10 | Added | Paint waste dispersed in larger particle and rapidly settled | Fair |
| 5 | " | 50 | 25 | 25 | Not added | Paint waste dispersed in larger particle Sedimentation: slow | Excellent |
| 6 | " | 50 | 10 | 40 | Not added | Dispersion: impossible | Poor |
| 7 | Waste lubricating oil | 50 | 50 | — | Added | Paint waste dispersed in fine particle Sedimentation: rapid | Good |
| 8 | " | 50 | 25 | 25 | Added | Paint waste | Very |

Table-continued

| | Example of mixing ratio of paint waste, waste oil and water | | | | | | |
|---|---|---|---|---|---|---|---|
| | Mother liquor | Mixing ratio (wt%) | | | | | |
| | | Paint waste | Mother liquor | Water | Detergent | Remarks | Result |
| | | | | | | dispersed in fine particle Sedimentation: slow | excellent |
| 9 | Water | 50 | — | 50 | Not added | Dispersion: impossible | Poor |

What is claimed is:

1. The method of disposing of solid or paste-like paint waste, comprising comminuting said paint waste to form small particles of said paint waste of a size to be suspendable in oil, dispersing said particles in suspension in a carrier liquid comprising oil to form a low sedimentation-rate flowable slurry, and incinerating said slurry to provide substantially complete combustion of said paint waste.

2. The method of claim 1, in which said oil is waste oil.

3. The method of claim 1, in which said oil is detergent-type oil.

4. The method of claim 1, in which said carrier liquid comprises a mixture of said oil with water.

5. The method of claim 1, in which said carrier liquid comprises a mixture of detergent-type waste oil and water.

6. The method of claim 5, in which said mixture is from about 40 to about 60 percent of water.

7. The method of disposal of paint waste of solid or paste-like form, characterized by cutting the paint waste into particles, mixing the paint waste particles with waste oil and water to form a slurry, feeding said slurry to a wet-type disintegrator to crush the paint waste particles into smaller-sized particles for dispersal in said slurry to form a low sedimentation-rate slurry, and feeding said low sedimentation-rate slurry to an incinerator for burning the paint waste with the waste oil.

* * * * *